US010781593B1

(12) United States Patent
Ellingson et al.

(10) Patent No.: US 10,781,593 B1
(45) Date of Patent: Sep. 22, 2020

(54) METAL LOCKING AND UNLOCKING TOOL

(71) Applicants: Tracy Ellingson, Anoka, MN (US); Bill Anderson, Anoka, MN (US)

(72) Inventors: Tracy Ellingson, Anoka, MN (US); Bill Anderson, Anoka, MN (US)

( * ) Notice: Subject to any disclaimer, the term of this patent is extended or adjusted under 35 U.S.C. 154(b) by 60 days.

(21) Appl. No.: 15/936,194

(22) Filed: Mar. 26, 2018

(51) Int. Cl.
*B25B 27/14* (2006.01)
*E04D 15/04* (2006.01)
*E04G 23/00* (2006.01)

(52) U.S. Cl.
CPC ..... *E04D 15/04* (2013.01); *B25B 27/14* (2013.01); *E04G 23/00* (2013.01)

(58) Field of Classification Search
CPC ..... B25B 7/02; B25B 27/14; E04D 15/04; E04G 23/00
See application file for complete search history.

(56) References Cited

U.S. PATENT DOCUMENTS 2,638,025 A * 5/1953 Nelson ..... B25B 27/14 29/270
2014/0373689 A1* 12/2014 Sildve ..... B25B 7/02 81/416

* cited by examiner

*Primary Examiner* — Lee A Holly
(74) *Attorney, Agent, or Firm* — Johnson and Phung LLC; Thomas N. Phung

(57) ABSTRACT

A metal locking and unlocking tool for conveniently locking and also unlocking in particular sheets of metal such as shingles. The metal locking and unlocking tool includes A rigid sheet of material having a handle and a working end portion for engaging, locking and unlocking an object such as a sheet of metal.

7 Claims, 3 Drawing Sheets

METAL LOCKING AND UNLOCKING TOOL

BACKGROUND OF THE INVENTION

Field of the Invention

The present invention relates to locking and unlocking tools and more particularly pertains to a new metal locking and unlocking tool for conveniently locking and also unlocking, in particular sheets of metal such as shingles.

Description of the Prior Art

The use of locking and unlocking tools is known in the prior art. More specifically, locking and unlocking tools heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a rectangular blade with slots and teeth on its front and back edges. This shingle popper has a special blade structure having elongated protrusions on its bottom side. The protrusions provide a front and back pivoting points so that the popper can be properly levered for easy removal of shingles and nails. Another prior art includes a handle, a shaft connected to the handle, and a base connected to the shaft. A length of the shaft is adjustable. The base includes a blade portion that is configured to separate one or more shingles from a support structure to which the shingles are affixed. While these devices fulfill their respective, particular objectives and requirements, the aforementioned patents do not disclose a new metal locking and unlocking tool.

SUMMARY OF THE INVENTION

The general purpose of the present invention, which will be described subsequently in greater detail, is to provide a new metal locking and unlocking tool which has many of the advantages of the locking and unlocking tools mentioned heretofore and many novel features that result in a new metal locking and unlocking tool which is not anticipated, rendered obvious, suggested, or even implied by any of the prior art locking and unlocking tools, either alone or in any combination thereof. The present invention includes a rigid sheet of material having a handle and a working end portion for engaging, locking and unlocking an object such as a sheet of metal. None of the prior art includes the combination of the elements of the present invention.

There has thus been outlined, rather broadly, the more important features of the metal locking and unlocking tool in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new metal locking and unlocking tool which has many of the advantages of the locking and unlocking tools mentioned heretofore and many novel features that result in a new metal locking and unlocking tool which is not anticipated, rendered obvious, suggested, or even implied by any of the prior art locking and unlocking tools, either alone or in any combination thereof.

Still another object of the present invention is to provide a new metal locking and unlocking tool for conveniently locking and also unlocking in particular sheets of metal such as shingles.

Still yet another object of the present invention is to provide a new metal locking and unlocking tool that serves conveniently as a dual-purpose tool Even still another object of the present invention is to provide a new metal locking and unlocking tool that saves many manhours for replacing sections of metal shingles or sidings These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
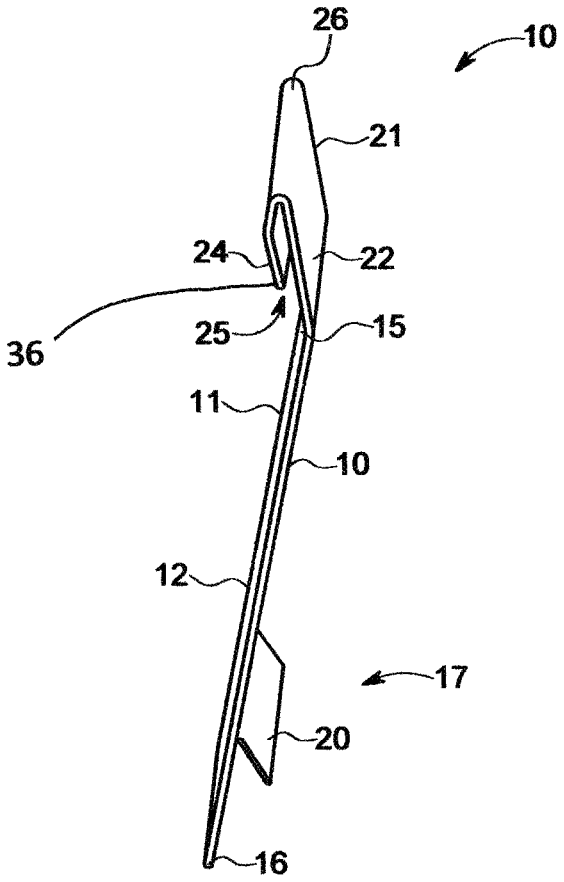
FIG. 1 is a side perspective view of a new metal locking and unlocking tool according to the present invention.
Figure 2:
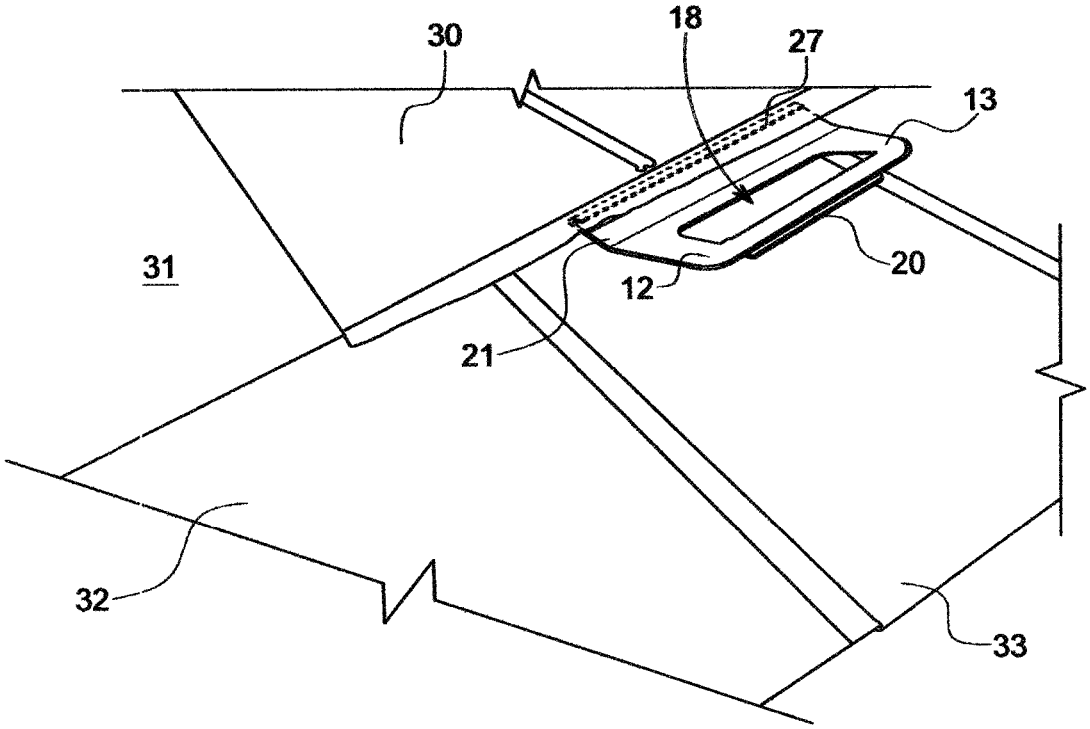
FIG. 2 is a top perspective view of the present invention in use.
Figure 3:
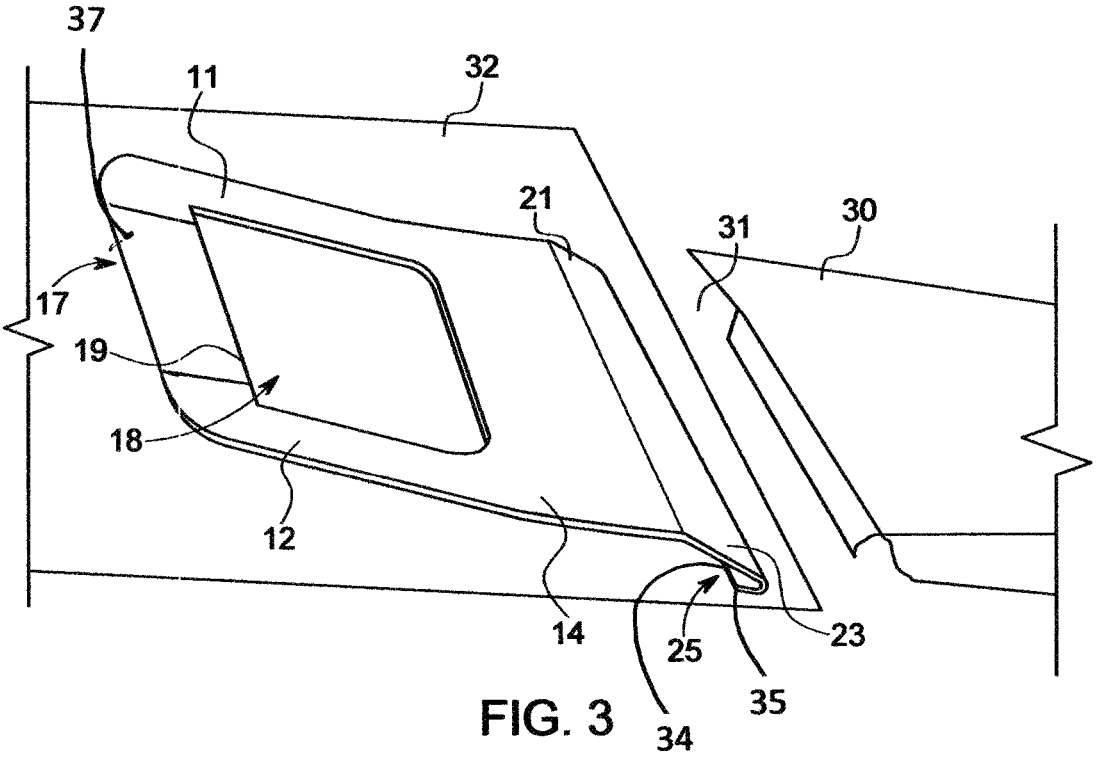
FIG. 3 is a bottom perspective view of the present invention in use.

With reference now to the drawings, and in particular to FIGS. 1 through 3 thereof, a new metal locking and unlocking tool embodying the principles and concepts of the present invention and generally designated by the reference numeral 10 will be described.

As best illustrated in FIGS. 1 through 3, the metal locking and unlocking tool 10 generally a rigid sheet of material 11 having a handle 17 and a working end portion 21 for engaging, locking and unlocking an object 30 such as a sheet of metal. The sheet of material 11 further includes a planar main portion 12 having a back end 16 and a front end 15 with the working end portion 21 integrally connected to the front end 15. The handle 17 includes an opening 18 disposed through the main portion 12 proximate to the back end 16 thereof and also has a rubberized covering 37. The main portion 12 has a top side 13 and a bottom side 14 and the opening 18 has a back edge 19. The handle 17 further includes a rigid strip of material 20 integrally connected to the sheet of material 11 along the back edge 19 of the opening 18. The strip of material 20 is angled outwardly relative to the bottom side 14 and extending towards the back end 16 of the main portion 12 for a user to easily grasp and manipulate the sheet of material 11. The working end portion 21 extends a width of the main portion 12 and is angled outwardly relative to the top side 13 of the main portion 12. The working end portion 21 includes a planar inner portion 22 which is integrally connected to the main portion 12 and also includes an outer portion 24 integrally connected to the inner portion 22 for engaging, pivoting, pushing, locking and unlocking the object 30. The outer portion 24 is curved back upon and spaced from and disposed parallel to the inner portion 22 and extends a width of the working end portion 21 and forms a narrow channel 25 between the inner portion 22 and the outer portion 24 for receiving an edge of the object 30 to unlock and remove the object 30. The outer portion 24 is curved back upon a partial section 23 of the inner portion 22 and forming a hook 27 for receiving and engaging the edge of the object 30 and also forming a butt end 26 for engaging and pushing the edge of the object 30. The outer portion 24 has a rounded outer edge 34 and rounded corners 35, 36 to facilitate receiving the edge of the object 30 in the narrow channel 25.

In use, the user engages the working end portion 21 with the edge of the object 30 by receiving the edge of the object 30 into the channel 25 and the user then pivots the working end portion 21 to flip the edge of the object 30 away from a structure 31 to unlock and remove the object 30 from the structure 31 and from one or more other objects 32, 33. To lock the object 30 in place with the other one more objects 32, 33 upon the structure 31, the user uses the working end portion 21 and urges the edge of the object 30 upon the structure 31 to lock the object 30 with the one or more other objects 32, 33. The user uses the butt end 26 of the sheet of material 11 to engage, move and lock the edge of the object 30 with the one or more other objects 32, 33 upon the structure 31.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the metal locking and unlocking tool. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A metal locking and unlocking tool comprising:

a rigid sheet of material having a handle and a working end portion for engaging, locking and unlocking a sheet of metal, the sheet of material including a planar main portion having a back end and a front end with the working end portion integrally connected at the front end, the handle including an opening disposed through the main portion proximate to the back end thereof and has a rubberized covering, and the main portion having a top side and a bottom side and the opening having a back edge, wherein the handle further includes a rigid strip of material integrally connected to the sheet of material along the back edge of the opening.

2. The metal locking and unlocking tool as described in claim 1, wherein the working end portion extends a width of the main portion and is angled outwardly relative to the top side of the main portion.

3. The metal locking and unlocking tool as described in claim 2, wherein the working end portion includes a planar inner portion which is integrally connected to the main portion and also includes an outer portion integrally connected to the inner portion for engaging, pivoting, pushing, locking and unlocking the object.

4. The metal locking and unlocking tool as described in claim 3, wherein the outer portion is curved back upon and spaced from and disposed parallel to the inner portion and extends a width of the working end portion and forms a narrow channel between the inner portion and the outer portion for receiving an edge of the object to unlock and remove the object.

5. The metal locking and unlocking tool as described in claim 3, wherein the outer portion is curved back upon a partial section of the inner portion and forming a hook for receiving and engaging the edge of the object and also forming a butt end for engaging and pushing the edge of the object.

6. The metal locking and unlocking tool as described in claim 3, wherein the outer portion has a rounded outer edge and rounded corners to facilitate receiving the edge of the object in the narrow channel.

7. The metal locking and unlocking tool as described in claim 1, wherein the strip of material is angled outwardly relative to the bottom side and extending towards the back end of the main portion for a user to easily grasp and manipulate the sheet of material.

* * * * *